United States Patent [19]

Lee

[11] Patent Number: 4,528,873

[45] Date of Patent: Jul. 16, 1985

[54] TWIST SET RATCHET WRENCH

[76] Inventor: Frank Lee, No. 5-11, La. 42, Jen Hua Rd., Ta Li Hsiang, Taichung Hsien, Taiwan, 407

[21] Appl. No.: 527,872

[22] Filed: Aug. 30, 1983

[51] Int. Cl.[3] ..... B25B 13/46; B25B 17/00

[52] U.S. Cl. ..... 81/57.29; 81/58.1; 81/63

[58] Field of Search ..... 81/60–63.2, 81/58.1, 57.29

[56] References Cited

U.S. PATENT DOCUMENTS

| | | | |
|---|---|---|---|
| 4,128,025 | 12/1978 | Main et al. | 81/57.29 X |
| 4,137,801 | 2/1979 | Imperio | 81/62 X |
| 4,448,095 | 5/1984 | Blodgett et al. | 81/62 X |

FOREIGN PATENT DOCUMENTS

| | | | |
|---|---|---|---|
| 1559093 | 1/1980 | United Kingdom | 81/63.2 |

*Primary Examiner*—Frederick R. Schmidt
*Assistant Examiner*—Debra S. Meislin
*Attorney, Agent, or Firm*—Armstrong, Nikaido, Marmelstein & Kubovcik

[57] ABSTRACT

This invention relates a twist set ratchet handle characterized by manipulating two controlled bevel wheel assemblies which mesh with each other and run clockwise and counter clockwise so that the ratchet head can be operated by turning the handle only or by turning the handle and the ratchet holder together. So it is a new, exquisite, convenient, multi-purpose ratchet handle.

3 Claims, 3 Drawing Figures

TWIST SET RATCHET WRENCH

BACKGROUND AND SUMMARY OF THE INVENTION

Conventional ratchet wrenches have the following disadvantages in design and use:

1. To turn a nut which is just put on a screw or just loosened, a conventional ratchet wrench must be swung. If there is no space for such swing, the wrench should be substituted by hand. When turning a nut unaccessible to hand, such as the replacing of a spark plug, operation difficulties would take place.
2. A conventional ratchet wrench with direction change knob is to tighten the nut when the knob is turned counterclockwise. This would make the user confused in direction changing, especially when the nut is turned over a screw upside down.

To eliminate these disadvantages, the inventor developed a ratchet handle of which the ratchet head will turn in the same clockwise or counterclockwise direction as the handle does and which can turn a nut without need to swing the handle. It can also be turned as a whole like a conventional ratchet wrench. So the convenience for use in different places and conditions is greatly increased.

Another purpose of this invention is to provide a ratchet handle of which the handle turns in the same direction as the nut is turned. Thus, the operator will not be confused in changing the clockwise/counterclockwise direction.

DETAILED DESCRIPTION

Figure 1:
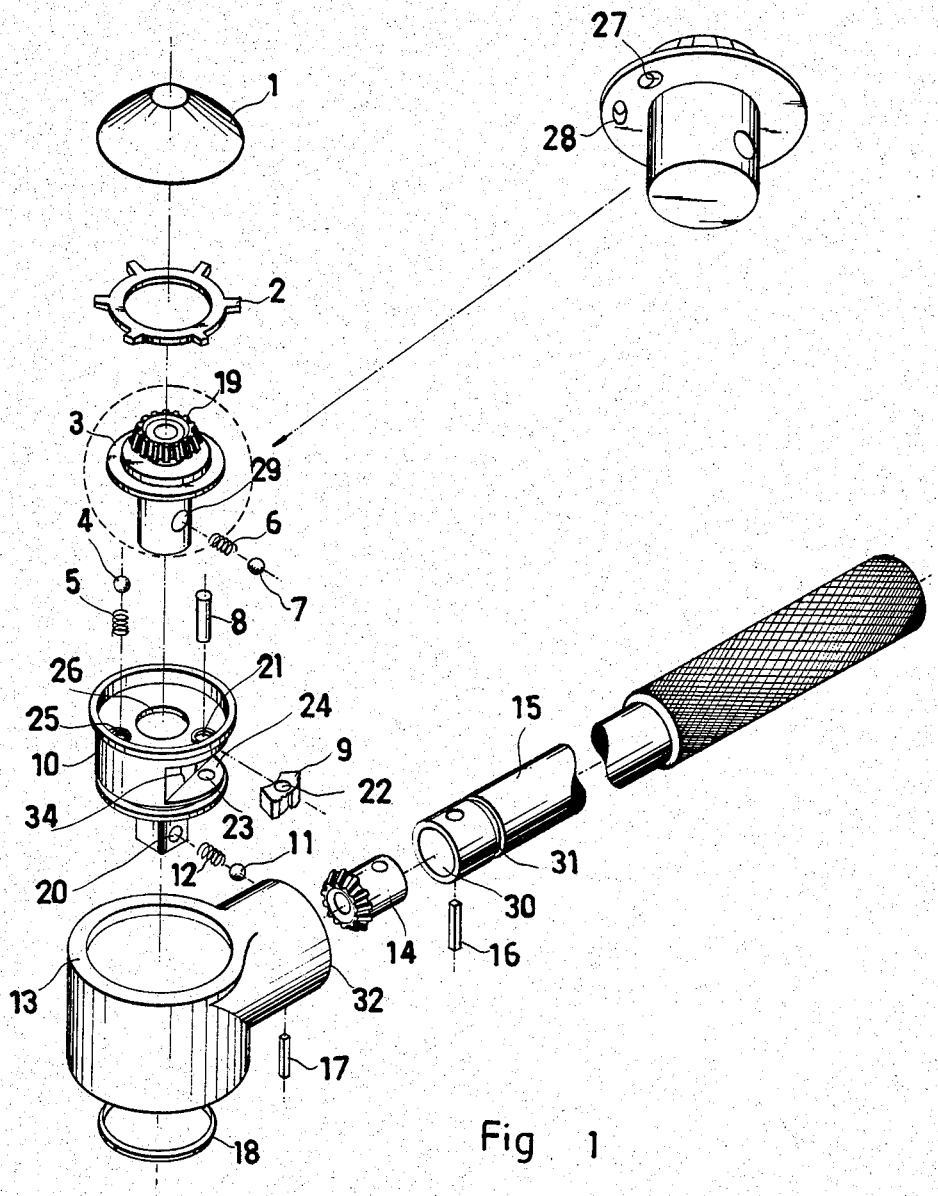
FIG. 1 is a perspective view of the twist set ratchet handle of this invention.

This invention provides a twist set ratchet handle of which the change of direction is controlled by the handle instead of a knob as a conventional ratchet wrench. With this mechanism, the ratchet head will turn in the same direction as the handle does, i.e. when the handle is turned clockwise, the ratchet head will also be turned clockwise. The handle can be turned separately or together with the ratchet holder to turn the ratchet head without the inconvenience of the direction change knob of a conventional ratchet wrench. Besides, the same clockwise/counterclockwise turning direction of the handle and the nut help the operator get rid of the confusion in changing directions.

Figure 3:
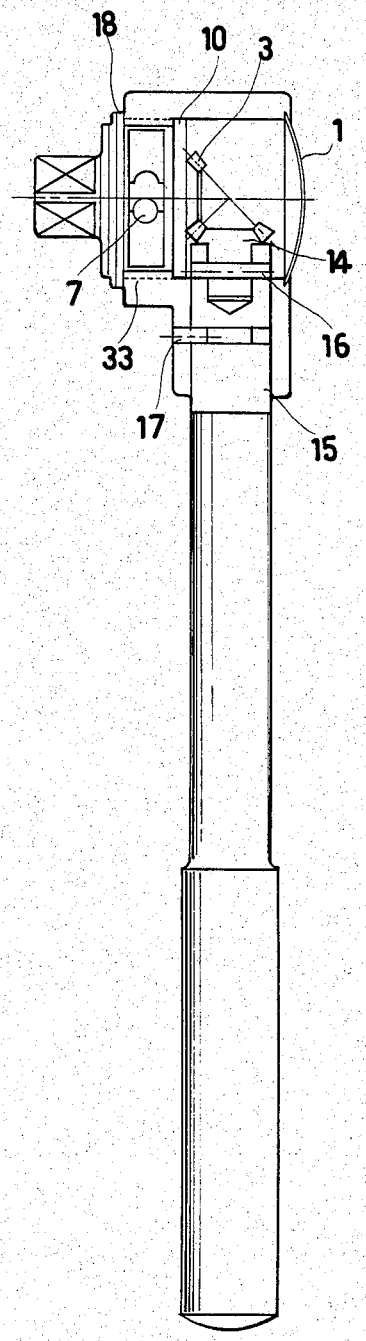
FIG. 3 is a vertical section of the twist set ratchet handle of this invention.
Figure 2:
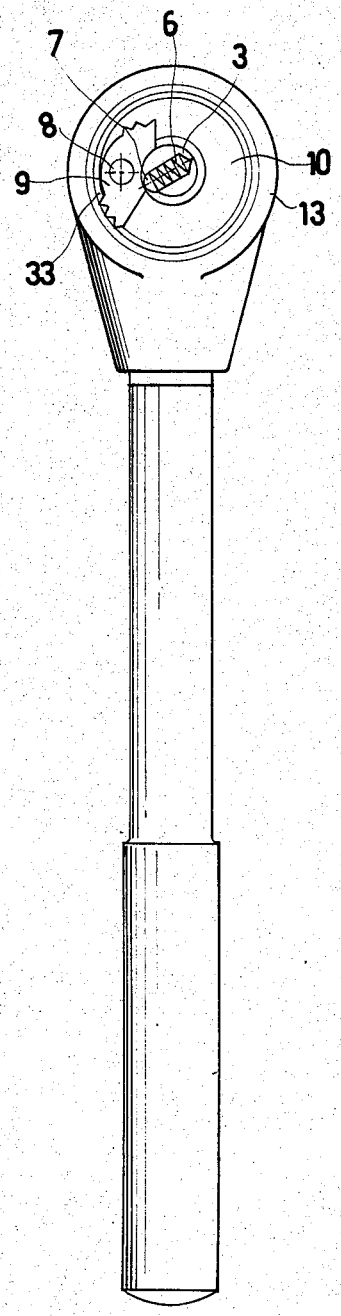
FIG. 2 is a top section of the twist set ratchet handle of this invention.

Referring now to the drawings, the construction and characteristics of this invention are described as follows:

As shown in FIG. 1, FIG. 2 and FIG. 3, the spring 12 and the ball 11 are put in the hole 20 in the stem of the ratchet head 10. The peripheral edge of the hole 20 is hammered into a ring to retain the ball 11 and a pin 8 is inserted in the hole 21 in the ratchet head 10 through the pin hole 22 in the ratchet 9 and the hole 23 in the bottom. Then the spring 5 and ball 4 are put in the hole 25 in the ratchet head 10 and the spring 6 and ball 7 are put in the hole 29 in the cam disc 3 which is then put in the hole 26 in the ratchet head 10. One of the two angled holes 27, 28 made in the back of the cam disc 3 is in alignment with the ball 4 which keeps the cam disc 3 in place. The stop ring 2 is pressed in the ratchet head 10 and keep the cam disc 3 from moving upwards when it turns. After the above elements are finished assembling, the whole assembly of the ratchet head 10 is fitted in the ratchet holder 13 and a retaining ring 18 is used to retain the ratchet head 10. After the bevel wheel 14 is fitted in the hole 30 in the handle 15, the bevel wheel 14 and the tubular handle 15 are fastened together by means of a spring pin 16. After this, the handle 15 is fitted in the side hole 32 in the ratchet holder 13 and locked into place by means of a spring pin 17 which keys into groove 31 so that the handle 15 can not move back and forth but turns freely. Finally, the cover 1 is pressed in the top of the ratchet 13 to keep off dust.

The main element of the assembly is cam disc 3 which not only drives the ratchet head but also changes the direction. These functions are described as follows:

Beginning with the configuration in which ball 4 is partially inserted in sloped notch 27, when the handle is twisted or rotated about its longitudinal axis in a clockwise direction as viewed from the end of the handle, the bevel gear 14 drives bevel gear 19 on cam disc 3, causing it to turn clockwise as viewed from the top of ratchet holder 13. Ball 4, is forced downward by the notch, which has a ramp angle of approximately 40 degrees. Simultaneously, ball 7 enters the half-circular passageway 34 in ratchet head 10. As the disc 3 continues to turn, ball 4 resides entirely in hole 25 of ratchet head 10. Ratchet head 10 does not rotate because ratchet pawl 9 is engaged to the inner margin of the ratchet holder 13. When the leading edge of sloped notch 28 uncovers ball 4, ball 4 rises to partially enter notch 28 and, at the same time, ball 7 emerges from passageway 34 to engage the inner edge of pawl 9, forcing the pawl into the position shown in FIG. 2, in which the teeth of the pawl engage the inner margin of holder 13. In this position, ratchet head 10 moves freely in a clockwise direction, but is prevented from rotating in a counterclockwise direction by the engagement of the teeth of the pawl in holder 13. Continued twisting of the handle in a clockwise direction causes clockwise rotation of the ratchet, any attached spanner socket, and any nut or bolt around which the spanner socket is placed. When the ratchet components are in the above described positions, the handle may also be used as a lever so as to operate the ratchet in the conventional manner. The holder may be freely moved in a counterclockwise direction but transmits force without slippage when rotated clockwise.

When the handle is twisted in a counterclockwise direction, ball 4 is forced back into hole 25, disc 3 rotates to the position in which ball 4 enters notch 27 and ball 7 engages the pawl at the opposite end, canting the pawl in the opposite direction and allowing the ratchet to be used to drive a nut or bolt in a counterclockwise direction.

As can be understood from the foregoing description, it is possible to set the direction in which a nut or bolt may be turned when the wrench is used in positions in which it is not possible for the user to see or touch the head of the ratchet. Furthermore, it is possible to turn a nut or bolt when there is insufficient room for the ratchet handle to be moved back and forth so as to turn the nut or bolt and it is also possible to rotate a nut or bolt when the friction between the engaged threads is insufficient to overcome the frictional force between the pawl and the ratchet holder, a condition frequently encountered when threads are being started or when a nut is being removed from the end of a stud or bolt.

What is claimed is:

1. A ratchet wrench, wherein a direction of rotation of a workpiece drive means is selected by rotation of a handle about its longitudinal axis comprising:

a. a ratchet holder comprising a unitary structure defined by two intersecting, joined cylinders having longitudinal axes crossing each other and longitudinal bores, one of the bores being open at both its ends and the other bore having a blind end;

b. a handle, one end of which is inserted into the blind end of said ratchet holder so as to be freely rotatable about its longitudinal axis;

c. a first bevel gear attached to the inserted end of the said handle;

d. a cylindrical ratchet head inserted into said ratchet holder and bearing a workpiece drive means at one end and a pawl, pivoted at its middle, on a surface of an outer curved side of said ratchet head;

e. a shaft inserted into an opening in the end of said ratchet head opposite the workpiece drive means;

f. a second bevel gear having a gear surface having teeth thereon and a flat surface, said second bevel gear being firmly attached at one end of said shaft, said gear being oriented such that the teeth of said second bevel gear are directed away from the opposite end of the shaft and away from said workpiece drive means, said gear being in constant mesh with said first bevel gear;

g. a flat disc having opposite facing flat surfaces and having a hole in the center through which said shaft is fitted, said disc being firmly attached to the flat surface of said second bevel gear, said flat disc having two notches formed in the surface directed away from the teeth of said second bevel gear, each notch being formed at a location and having an upper surface at an angle to a plane of the disc such that projections of said upper surfaces intersect at a point on the second bevel gear side of a plane of the notched surface of the disc;

h. a first spring-loaded means carried within the ratchet head and engageable alternatively in one of said notches formed in the surface of said disc when said handle is rotated to bring one of said notches into coincidence with said spring-loaded means;

i. a second spring-loaded means carried in said shaft and projected at 90 degrees to said shaft so as to project through an opening in said ratchet head and to engage alternatively one end of said pawl when said handle is rotated; and j. means for securing said ratchet head and shaft within said ratchet holder providing tension sufficient to maintain said disc in intimate contact with said ratchet head, wherein, after the direction of rotation of said ratchet head has been selected by rotation of the handle, said ratchet head is driven by twisting said handle about its longitudinal axis or, alternatively, by moving said handle in a plane defined by rotating the handle 360 degrees about a longitudinal axis of said ratchet head.

2. The ratchet wrench of claim 1 wherein at least one of said first and second spring-loaded means includes a ball.

3. The ratchet wrench of claim 1 wherein the means for securing said ratchet head and shaft within said ratchet holder is a stop ring pressed into a groove in said ratchet holder.

* * * * *